US011781372B2

(12) United States Patent
Vaidya et al.

(10) Patent No.: US 11,781,372 B2
(45) Date of Patent: Oct. 10, 2023

(54) DOOR ASSEMBLIES WITH INSULATED GLAZING UNIT VENTING

(71) Applicant: Masonite Corporation, Tampa, FL (US)

(72) Inventors: Abhishek Vaidya, Schaumburg, IL (US); Steven B. Swartzmiller, Batavia, IL (US); Wendell S. Yoder, Saint Charles, IL (US); Robert C. Allen, Elburn, IL (US); Jan H. Ettrich, Geneva, IL (US)

(73) Assignee: Masonite Corporation, Tampa, FL (US)

( * ) Notice: Subject to any disclaimer, the term of this patent is extended or adjusted under 35 U.S.C. 154(b) by 66 days.

(21) Appl. No.: 17/712,844

(22) Filed: Apr. 4, 2022

(65) Prior Publication Data

US 2022/0228427 A1 Jul. 21, 2022

Related U.S. Application Data

(60) Division of application No. 16/867,329, filed on May 5, 2020, now Pat. No. 11,293,212, which is a (Continued)

(51) Int. Cl.
*E06B 3/677* (2006.01)
*E06B 3/58* (2006.01)
(Continued)

(52) U.S. Cl.
CPC ..... *E06B 3/677* (2013.01); *E06B 3/549* (2013.01); *E06B 3/5892* (2013.01); *E06B 3/64* (2013.01);
(Continued)

(58) Field of Classification Search
CPC ..... E06B 3/677; E06B 3/549; E06B 3/5892; E06B 3/64; E06B 3/66; E06B 3/66304;
(Continued)

(56) References Cited

U.S. PATENT DOCUMENTS 1,982,351 A * 11/1934 Phillips ..... E06B 3/677 52/204.595
2,202,694 A 5/1940 Haux
(Continued)

*Primary Examiner* — Brent W Herring
(74) *Attorney, Agent, or Firm* — Calderon, Safran & Cole P.C.

(57) ABSTRACT

A door assembly includes a doorframe, an insulated glazing unit (IGU), door skins, and a gas passageway. The IGU includes a substantially sealed IGU cavity and a hole communicating with the IGU cavity. The door skins are secured to opposite sides of the doorframe and have openings between which the IGU is provided. The gas passageway provides gas communication between the IGU cavity and the atmosphere outside of the door assembly. The gas passageway contains a gas passage conduit that includes a first end communicating with the IGU cavity through the hole and a second end communicating with atmosphere outside of the door assembly. The gas passageway may contain a gas passage conduit having a first end communicating with the IGU cavity through the first hole and a second end communicating with an air pocket, and a channel connects the air pocket with atmosphere outside of the door assembly.

18 Claims, 10 Drawing Sheets

Related U.S. Application Data continuation of application No. 15/662,814, filed on Jul. 28, 2017, now abandoned.

(60) Provisional application No. 62/368,556, filed on Jul. 29, 2016.

(51) Int. Cl.

| | |
|---|---|
| ***E06B 3/82*** | (2006.01) |
| ***E06B 3/66*** | (2006.01) |
| ***E06B 3/54*** | (2006.01) |
| ***E06B 3/64*** | (2006.01) |
| ***E06B 3/663*** | (2006.01) |
| ***E06B 3/72*** | (2006.01) |
| ***E06B 9/264*** | (2006.01) |
| *E06B 3/70* | (2006.01) |

(52) U.S. Cl.

CPC ..... *E06B 3/66* (2013.01); *E06B 3/66304* (2013.01); *E06B 3/72* (2013.01); *E06B 3/822* (2013.01); *E06B 9/264* (2013.01); *E06B 2003/708* (2013.01); *E06B 2009/2643* (2013.01)

(58) Field of Classification Search

CPC . E06B 3/72; E06B 3/822; E06B 9/264; E06B 2003/708; E06B 2009/2643

USPC ..... 52/204.5, 209, 172, 204.593, 204.595; 454/212, 198

See application file for complete search history.

(56) References Cited

U.S. PATENT DOCUMENTS

| | | | | |
|---|---|---|---|---|
| 2,207,745 | A | 7/1940 | Lipsett | |
| 2,233,952 | A | 3/1941 | Lipsett | |
| 2,278,694 | A * | 4/1942 | Firner | E06B 3/66347 52/204.595 |
| 2,933,780 | A | 4/1960 | Shinefeld | |
| 2,934,801 | A | 5/1960 | Blaszkowski | |
| 3,771,276 | A * | 11/1973 | Stewart | E06B 3/677 96/133 |
| 4,327,535 | A | 5/1982 | Governale | |
| 4,374,693 | A | 2/1983 | Pitt | |
| 4,496,201 | A | 1/1985 | Allgeyer | |
| 4,627,206 | A | 12/1986 | Cox | |
| 4,674,243 | A | 6/1987 | Schoofs | |
| 4,720,951 | A | 1/1988 | Thorn et al. | |
| 4,819,405 | A * | 4/1989 | Jackson | E06B 3/677 52/235 |
| 4,850,168 | A | 7/1989 | Thorn | |
| 4,897,975 | A | 2/1990 | Artwick et al. | |
| 4,952,430 | A * | 8/1990 | Bowser | E06B 3/677 52/786.13 |
| 5,022,206 | A | 6/1991 | Schield et al. | |
| 5,105,597 | A | 4/1992 | Wilkening | |
| 5,170,602 | A | 12/1992 | Ribic | |
| 5,299,399 | A | 4/1994 | Baier et al. | |
| 5,577,355 | A | 11/1996 | Leonelli | |
| 5,577,363 | A | 11/1996 | Tate et al. | |
| 5,890,331 | A * | 4/1999 | Hope | E06B 3/5892 52/204.52 |
| 6,003,277 | A | 12/1999 | Graham et al. | |
| 6,151,849 | A | 11/2000 | Twigg et al. | |
| 6,161,363 | A | 12/2000 | Herbst | |
| 6,434,898 | B1 | 8/2002 | Ward et al. | |
| 6,619,005 | B1 | 9/2003 | Chen | |
| 6,681,541 | B2 | 1/2004 | Wang Chen | |
| 6,916,392 | B2 | 7/2005 | Trpkovski et al. | |
| 7,543,416 | B2 | 6/2009 | Albertelli | |
| 7,588,653 | B2 | 9/2009 | Crandell et al. | |
| 7,765,769 | B2 | 8/2010 | Rosskamp et al. | |
| 8,112,860 | B2 | 2/2012 | Collins | |
| 8,584,411 | B2 * | 11/2013 | Mitchell | E06B 7/14 52/302.1 |
| 9,080,380 | B2 | 7/2015 | Thompson | |
| 9,125,510 | B2 | 9/2015 | Fulton et al. | |
| 9,290,989 | B2 | 3/2016 | Lynch | |
| 9,458,660 | B2 | 10/2016 | Gouge et al. | |
| 9,624,714 | B2 | 4/2017 | Gouge et al. | |
| 10,006,240 | B2 | 6/2018 | Gouge et al. | |
| 10,145,167 | B1 | 12/2018 | Wang | |
| 10,208,530 | B2 | 2/2019 | Gouge et al. | |
| 10,214,953 | B2 | 2/2019 | Wang | |
| 11,293,212 | B2 | 4/2022 | Vaidya | |
| 2002/0197422 | A1 | 12/2002 | Trpkovski et al. | |
| 2003/0005645 | A1 | 1/2003 | Wang Chen | |
| 2003/0070380 | A1 * | 4/2003 | Zurn | E06B 3/677 65/141 |
| 2004/0206021 | A1 | 10/2004 | Albertelli | |
| 2005/0028465 | A1 | 2/2005 | Horsfall et al. | |
| 2005/0132558 | A1 * | 6/2005 | Hennessy | E06B 3/677 29/458 |
| 2005/0144863 | A1 | 7/2005 | Collins | |
| 2005/0166491 | A1 | 8/2005 | Hornung et al. | |
| 2008/0209826 | A1 | 9/2008 | Hodges et al. | |
| 2008/0245003 | A1 | 10/2008 | Kon et al. | |
| 2016/0010386 | A1 | 1/2016 | Gouge et al. | |
| 2017/0022749 | A1 | 1/2017 | Gouge et al. | |
| 2017/0218684 | A1 | 8/2017 | Gouge et al. | |
| 2018/0080273 | A1 | 3/2018 | Wang | |
| 2018/0305971 | A1 | 10/2018 | Gouge et al. | |
| 2018/0340364 | A1 | 11/2018 | Wang | |
| 2019/0024445 | A1 * | 1/2019 | Chorine | E06B 3/66342 |
| 2019/0178023 | A1 | 6/2019 | Gouge et al. | |
| 2021/0172242 | A1 * | 6/2021 | Schreiber | E06B 3/67326 |
| 2021/0246714 | A1 * | 8/2021 | Neander | E06B 3/66366 |

* cited by examiner

DOOR ASSEMBLIES WITH INSULATED GLAZING UNIT VENTING

CROSS-REFERENCE TO RELATED APPLICATIONS AND CLAIM TO PRIORITY

This application is a continuation of U.S. application Ser. No. 16/867,329, filed May 5, 2020, now U.S. Pat. No. 11,293,212, which is a continuation of application Ser. No. 15/662,814, filed Jul. 28, 2017, which is related to U.S. Provisional Patent Application No. 62/368,556, filed Jul. 29, 2016, which is incorporated herein by reference in its entirety and to which priority is claimed.

FIELD OF THE INVENTION

This invention relates to door assemblies with vented insulated glazing units (IGU), and to methods of making and using the same.

BACKGROUND

Traditional solid wood doors have become relatively expensive due to raw material costs. A commonplace alternative to traditional solid wood doors in residential and commercial buildings is a door assembly that includes a rectangular doorframe of stiles and rails, and door skins secured to the opposite sides of the doorframe. The door skins can be made of, for example, steel, fiberglass composites, cellulosic (e.g., wood) composites, high density fiberboard (HDF), medium density fiberboard (MDF), and other materials. The door cavity between the door skins typically includes a core. The core can be a pre-formed structure or formed in situ, such as by injecting a foam precursor composition into the door cavity and allowing the precursor composition to expand and fill the door cavity with foam. Wood grain can be molded or embossed onto the exterior surfaces of the door skins. Further, paneling can be formed in the exterior surfaces of the door skins to give an appearance that simulates solid wood products.

The door assemblies may also include glazing inserts, especially IGUs, which are typically double-glazing (double-pane) or triple-glazing (triple-pane) structures with a sealed cavity between the panes. U.S. Pat. Nos. 9,290,989, 9,125,510, and 9,080,380 and U.S. Application Publication Nos. 2016/0010386 and 2008/0245003, each assigned to Masonite Corporation, disclose door assemblies including IGUs.

The inventors have determined that issues may arise when the door assembly construction does not permit gas flow exchange between the sealed cavity of the IGU and the outside atmosphere/environment. A lack of pressure balance between the IGU sealed cavity and the outside atmosphere can result in deflection of glazing panes—either inwardly towards the sealed cavity or outwardly away from the sealed cavity. A pressure differential can arise due to changes in temperature and/or altitude (for example, during shipping of the IGU-containing door assembly). Deflection of glazing panes caused by a pressure differential is particularly noticeable with Simulated Divided Lite (SDL) glazing units, such as when grilles of the SDL structure are applied on external or internal surfaces of the glazing panes. When the panes deflect inward or outward, for example due to temperature or altitude changes, the grilles deflect with the glazing panes or separate from the glazing panes, so that the IGU does not accurately simulate the appearance of a true divided light IGU. Lack of pressure balance in the IGU may also create stress along the sealed perimeter of the IGU. This can result in failure of the IGU's seal, thereby reducing the life of the IGU. In the case of IGUs with components such as blinds inside the sealed cavity, inward deflection (bowing) of the glazing panes can interfere with the blind raise/lower and/or tilting mechanism(s), resulting in performance issues.

SUMMARY OF THE INVENTION

A first aspect of the invention provides a door assembly including a doorframe having opposite first and second sides, an insulated glazing unit (IGU), first and second door skins, a door core component, and a gas passageway. The insulated glazing unit includes a substantially sealed IGU cavity and a first hole communicating with the substantially sealed IGU cavity. The first and second door skins are respectively secured to the first and second sides of the doorframe and have respective openings within which the insulated glazing unit is provided. The door core component is positioned within a door cavity between the first and second door skins and in direct contact with the insulated glazing unit. The gas passageway provides gas communication between the sealed IGU cavity and the atmosphere outside the door assembly. The gas passageway may include a gas passage conduit, e.g. a capillary, passing through at least a portion of the door core component, and including a first end communicating with the substantially sealed IGU cavity through the first hole and a second end communicating with the atmosphere outside of the door assembly.

A second aspect of the invention provides a door assembly including a doorframe having opposite first and second sides, an insulated glazing unit, first and second door skins, a gas passage conduit, and a channel. The insulated glazing unit includes an IGU spacer, a first glazing pane having a first exterior surface, a second glazing pane having a second exterior surface that is opposite to the first exterior surface, a substantially sealed IGU cavity, and a first hole communicating with the substantially sealed IGU cavity. The first and second door skins are respectively secured to the first and second sides of the doorframe and have respective openings within which the insulated glazing unit is provided. The first door skin has a first lip secured directly to the first exterior surface of the first glazing pane of the insulated glazing unit and the second door skin has a second lip secured directly to the second exterior surface of the second glazing pane. The gas passage conduit includes a first end communicating with the substantially sealed IGU cavity through the first hole and a second end communicating with an air pocket within the door assembly. The channel connects the air pocket with atmosphere outside of the door assembly. The gas passage conduit, the air pocket, and the channel provide a gas passageway for gas communication between the sealed IGU cavity and the atmosphere outside the door assembly.

A third aspect of the invention provides a door assembly including a doorframe having opposite first and second sides, an insulating glazing unit, first and second door skins, and a gas passage conduit. The insulated glazing unit includes a substantially sealed IGU cavity and a first hole communicating with the substantially sealed IGU cavity. The first and second door skins are respectively secured to the first and second sides of the doorframe and have respective first and second openings within which the insulated glazing unit is provided. The gas passage conduit includes a first end communicating with the substantially sealed IGU cavity through the first hole and a second end extending to and communicating with a second hole or an air pocket in the doorframe that communicates with atmosphere outside of the door assembly. The gas passage conduit and the air pocket provide a gas passageway to effect gas communication between the sealed IGU cavity and the atmosphere outside the door assembly.

A fourth aspect of the invention provides a method of making a door assembly. An insulated glazing unit (IGU) is provided between openings of first and second door skins, and the first and second door skins are respectively secured to opposite first and second sides of a doorframe. The insulated glazing unit has a first hole communicating with a substantially sealed IGU cavity of the insulated glazing unit. A first end of a gas passage conduit is positioned in communication with the first hole of the insulated glazing unit, and a second end of the gas passage conduit is positioned in communication with atmosphere outside of the door assembly to permit gas exchange between the IGU cavity and the atmosphere outside of the door assembly. A door core component is positioned within a door cavity between the first and second door skins and in direct contact with the insulated glazing unit, and the gas passage conduit passes through at least a portion of the door core component.

A fifth aspect of the invention provides a method of making a door assembly. An insulated glazing unit (IGU) is provided between openings of first and second door skins, and the first and second door skins are respectively secured to opposite first and second sides of a doorframe. The insulated glazing unit has a first hole communicating with a substantially sealed IGU cavity of the insulated glazing unit. The first door skin has a first lip secured directly to a first exterior surface of a first glazing pane of the insulated glazing unit and the second door skin has a second lip secured directly to a second exterior surface of a second glazing pane of the insulated glazing unit. A first end of a gas passage conduit is positioned in communication with the first hole of the insulated glazing unit, and a second end of the gas passage conduit is positioned in communication with an air pocket within the door assembly. The door assembly further includes a channel connecting the air pocket with atmosphere outside of the door assembly to permit gas exchange between the IGU cavity and the atmosphere outside of the door assembly. The gas passage conduit, the air pocket, and the channel provide a gas passageway for gas communication between the sealed IGU cavity and the atmosphere outside the door assembly.

A sixth aspect of the invention provides a method of making a door assembly. An insulated glazing unit (IGU) is provided between openings of first and second door skins, and the first and second door skins are respectively secured to opposite first and second sides of a doorframe. The insulated glazing unit has a first hole communicating with a substantially sealed IGU cavity of the insulated glazing unit. A first end of a gas passage conduit is positioned in communication with the first hole of the insulated glazing unit, and a second end of the gas passage conduit is positioned in communication with a second hole or an air pocket in the doorframe that communicates with atmosphere outside of the door assembly. The gas passage conduit, and the air pocket provide a gas passageway for gas communication between the sealed IGU cavity and the atmosphere outside the door assembly.

According to a seventh aspect of the invention, a method of venting a door assembly is provided. The door assembly includes a doorframe having opposite first and second sides, an insulated glazing unit (IGU), first and second door skins, a door core component, and a gas passage conduit. The insulated glazing unit includes a substantially sealed IGU cavity and a first hole communicating with the substantially sealed IGU cavity. The first and second door skins are respectively secured to the first and second sides of the doorframe and have respective openings between which the insulated glazing unit is provided. The door core component is positioned within a door cavity between the first and second door skins and in direct contact with the insulated glazing unit. Venting is performed through the gas passage conduit that passes through at least a portion of the door component and includes a first end communicating with the substantially sealed IGU cavity through the first hole and a second end communicating with atmosphere outside of the door assembly.

An eighth aspect of the invention provides a method of venting a door assembly. The door assembly includes a doorframe having opposite first and second sides, an insulated glazing unit (IGU), first and second door skins, and a channel. The insulated glazing unit includes an IGU spacer, a first glazing pane having a first exterior surface, a second glazing pane having a second exterior surface that is opposite to the first exterior surface, a substantially sealed IGU cavity, and a first hole communicating with the substantially sealed IGU cavity. The first and second door skins are respectively secured to the first and second sides of the doorframe and have respective openings between which the insulated glazing unit is provided. The first door skin has a first lip secured directly to the first exterior surface of the first glazing pane of the insulated glazing unit and the second door skin has a second lip secured directly to the second exterior surface of the second glazing pane of the insulated glazing unit. Venting is performed through a gas passage conduit and the channel. The gas passage conduit includes a first end communicating with the substantially sealed IGU cavity through the first hole and a second end communicating with an air pocket within the door assembly. The channel connects the air pocket with atmosphere outside of the door assembly. The gas passage conduit, the air pocket, and the channel provides a gas passageway for gas communication between the sealed IGU cavity and the atmosphere outside the door assembly.

A ninth aspect of the invention provides a method of venting a door assembly. The door assembly includes a doorframe having opposite first and second sides, an insulating glazing unit, first and second door skins, and a gas passage conduit. The insulated glazing unit includes a substantially sealed IGU cavity and a first hole communicating with the substantially sealed IGU cavity. The first and second door skins are respectively secured to the first and second sides of the doorframe and have respective first and second openings between which the insulated glazing unit is provided. The gas passage conduit includes a first end communicating with the substantially sealed IGU cavity through the first hole and a second end extending to and communicating with a second hole or an air pocket in the doorframe that communicates with atmosphere outside of the door assembly. Venting is performed through a gas passage conduit and the second hole or the air pocket. The gas passage conduit and the air pocket (or the second hole) provides a gas passageway for gas communication between the sealed IGU cavity and the atmosphere outside the door assembly.

Aspects and exemplary aspects, embodiments and methods described herein are particularly advantageous for and applicable to door packaging, transportation, and installation, especially pre-hung doors.

It should be understood that the various aspects of the invention described above may be combined with one another and that substitutions of components and/or steps of one aspect may be substituted into other aspects.

Other aspects of the invention, including pre-assembled kits, other assemblies, subassemblies, packaged and unpackaged door units, methods and processes, and the like which constitute part of the invention, will become more apparent upon reading the following detailed description of the exemplary embodiments.

BRIEF DESCRIPTION OF THE DRAWINGS

The accompanying drawings are incorporated in and constitute a part of the specification. The drawings, together with the summary given above and the detailed description of the exemplary embodiments and methods given below, serve to explain the principles of the invention. In such drawings.

DETAILED DESCRIPTION

Figure 1:
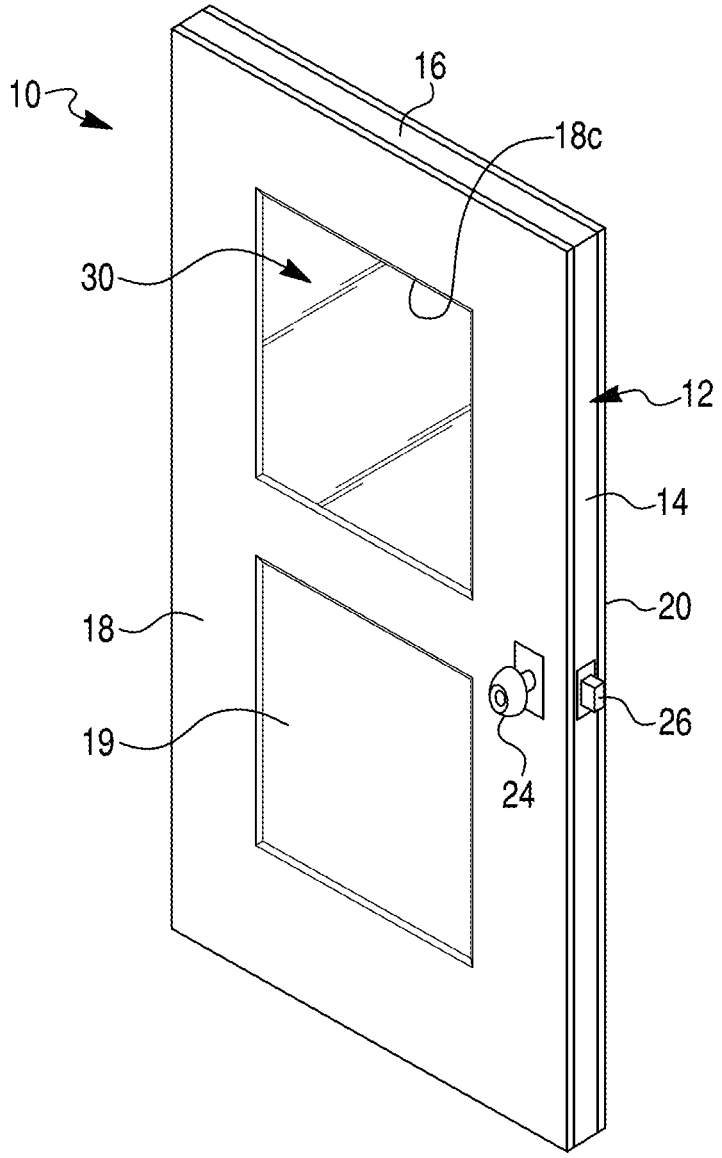
FIG. 1 is a perspective view of a door assembly with insulated glazing unit venting according to a first exemplary embodiment of the invention.

Reference will now be made in detail to the exemplary embodiments and methods as illustrated in the accompanying drawings, in which like reference characters designate like or corresponding parts throughout the drawings. It should be noted, however, that the invention in its broader aspects is not necessarily limited to the specific details, representative materials and methods, and illustrative examples shown and described in connection with the exemplary embodiments and methods.

Figure 2:
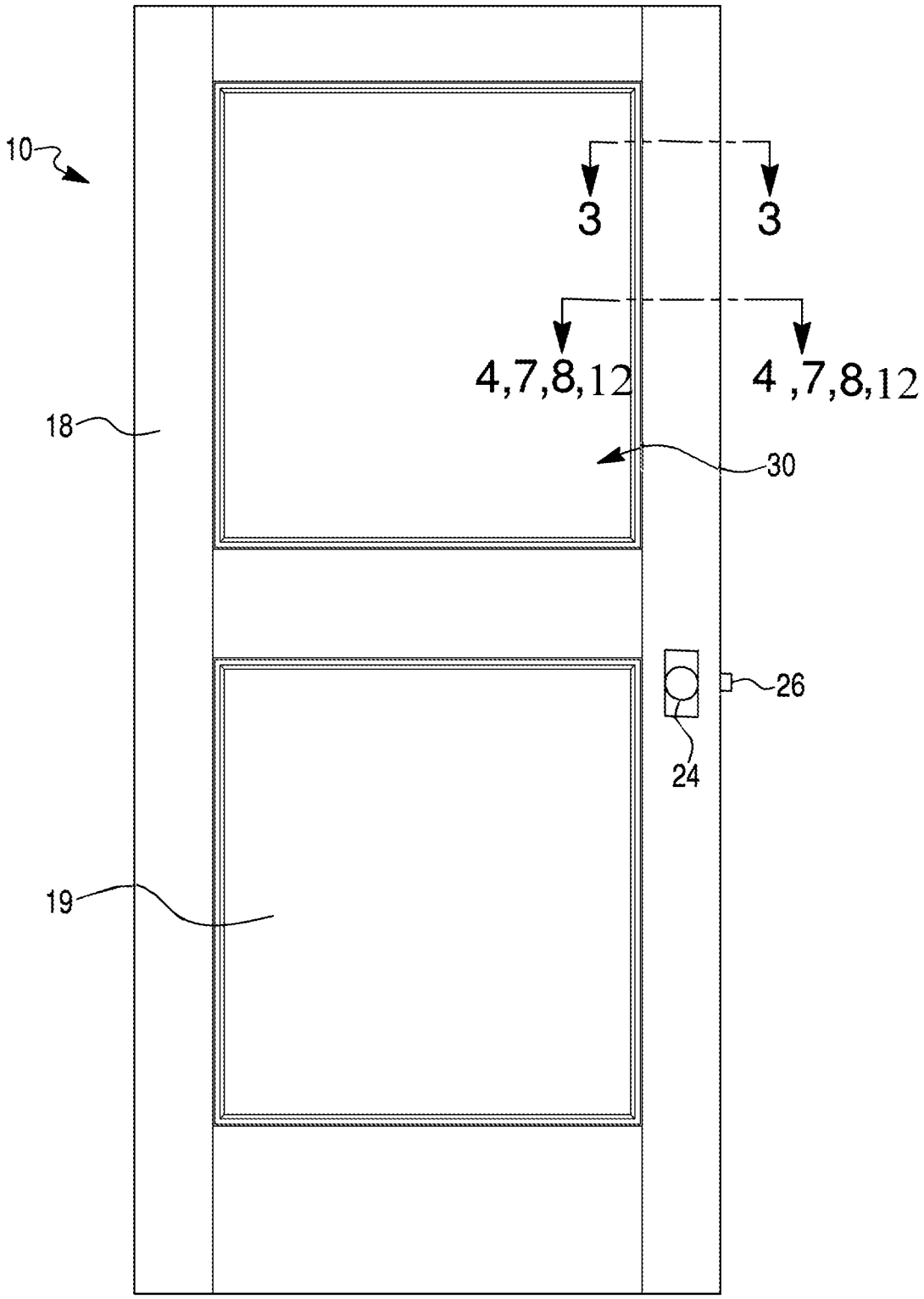
FIG. 2 is a front elevation of the door assembly of FIG. 1.

An exemplary door assembly is generally designated by reference numeral 10 in FIGS. 1 and 2, and is also referred to herein as door 10. Although the door assembly 10 is illustrated as an entryway door, it should be understood that the principles of the present invention may be applied to interior doors, residential doors, doors for commercial and industrial buildings, and the like.

Figure 3:
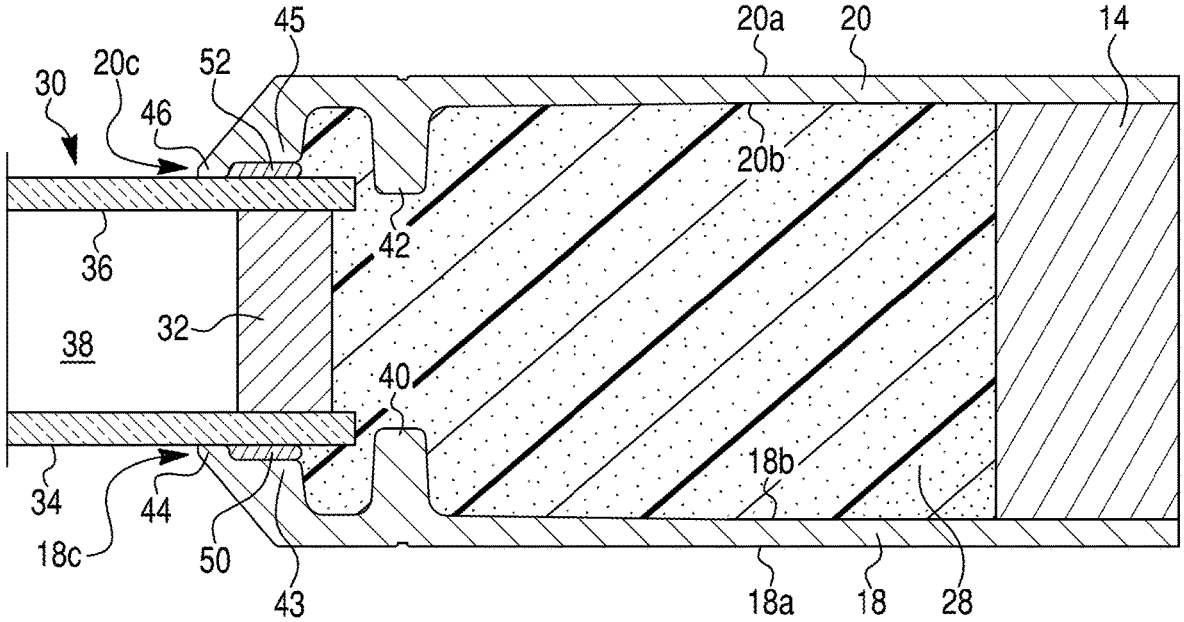
FIG. 3 is a cross-sectional view taken along sectional line 3-3 of FIG. 2.

As best shown in FIGS. 1 and 3, door assembly 10 includes a doorframe generally designated by reference numeral 12. The doorframe 12 includes a plurality of doorframe members connected to one another to establish a rectangular frame. In particular, the doorframe 12 includes first and second vertically extending stiles 14, of which the right stile, designated by reference numeral 14, is shown in FIG. 1. The stiles 14 are parallel to one another and spaced apart from one another to establish opposite sides (left and right sides) of the door assembly 10. The doorframe 12 further includes top and bottom horizontally extending rails at the top and bottom edges of the door assembly 10. In FIG. 1, the top rail, designate by reference numeral 16, is shown. The rails 16 are parallel to one another and spaced apart from one another at opposite ends (top and bottom ends) of the door assembly 10. The opposite ends of the rails 16 are secured by fasteners (e.g., screws, nails, or bolts) and/or adhesive to the stiles 14 to collectively form the rectangular doorframe 12. Although not shown, the doorframe 12 may further include intermediate stiles, intermediate rails, a lock block, hinge blocks and/or other supports and frame members. The door assembly 10 may be an entry door dimensioned to allow passage of an average size human. For example, standard door sizes range from about 10 inches to about 36 inches in width and about 6.5 feet to about 8 feet in height. The door assembly 10 may also be used with custom doors, including doors outside of the aforementioned ranges.

Figure 4:
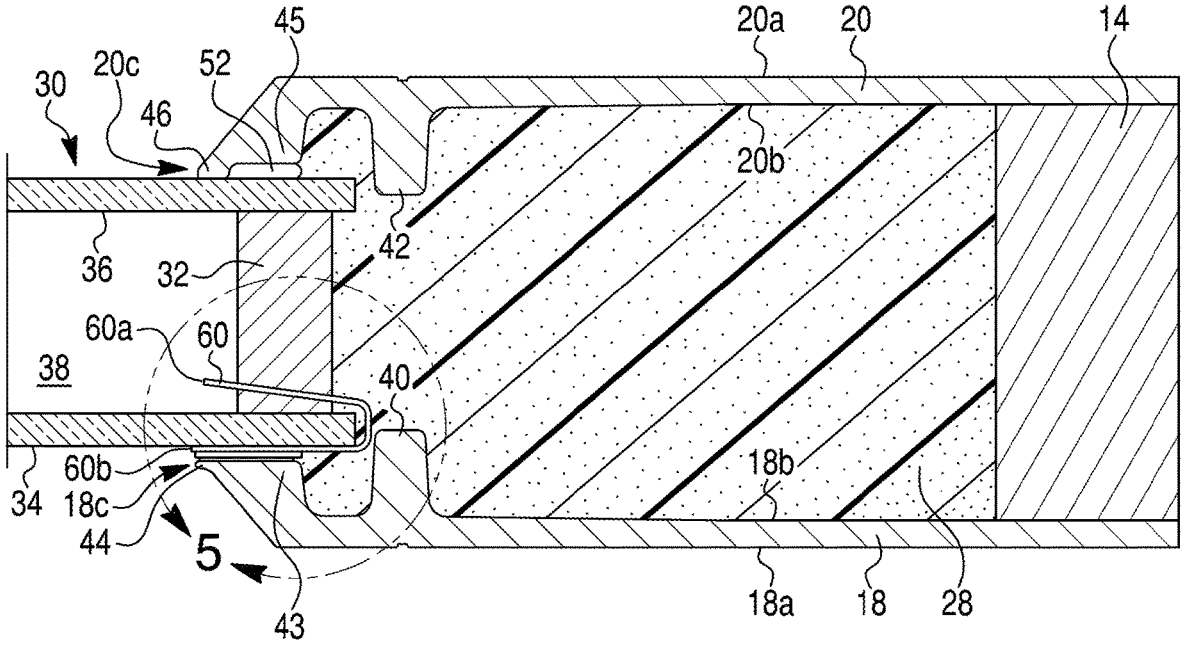
FIG. 4 is a cross-sectional view taken along sectional line 4-4 of FIG. 2.

The door assembly 10 further includes first and second door skins (also referred to in the art as door facings) 18 and 20, respectively. As best shown in FIGS. 3 and 4, the first door skin 18 includes an exterior surface 18*a* facing away from a first side of the doorframe 12 and an opposite interior surface 18*b* facing towards and secured to the first side of the doorframe 12. Likewise, the second door skin 20 includes an exterior surface 20*a* facing away from a second side of the doorframe 12 and an opposite interior surface 20*b* facing towards and secured to the second side of the doorframe 12. Adhesive and/or fasteners secure the door skins 18 and 20 to the opposite first and second sides of the doorframe 12. For example, a polyurethane or polyvinyl acetate adhesive may be used. In certain embodiments, the stiles and rails may be secured to the door skins 18, 20 only and need not be secured to each other. That way, the door skins 19, 20 holds the stiles and rails in place to form the doorframe 12.

The door skins 18 and 20 may be molded from an appropriate composite material and typically have a thickness of, for example, about 0.13 mm (0.05 inches) to about 52 mm (0.20 inches), depending on the door application in which they are used and the skin material selected. The selected material of the door skins 18 and 20 can be a sheet molding compound or "SMC" for short. Generally, SMCs include, for example, about 15 to about 30 weight percent of the thermosetting resin composition, about 3 to about 20 weight percent low profile additive, about 10 to about 30 weight percent reinforcement, typically fiberglass, and typically other ingredients, such as filler, fire retardants, mold release agents, shelf inhibitors, wetting agents, homogenizers, UV retardants, pigments, thickening agents, antioxidants, antistatic metals, colorants, and/or other additives.

Concentrations may be adjusted as warranted for obtaining desired properties. The above composition is provided by way of example, and is not limiting. Other natural or synthetic materials that may be selected for the door skins 18 and 20 include bulk molding compounds (BMCs), medium density fiberboard, high density fiberboard, reinforced thermoplastics (e.g., polypropylene, polystyrene), and metals such as steel. The door skins 18 and 20 may be made of the same or different materials.

Any suitable molding technique may be employed for making the door skins 18 and 20, including, for example, compression molding, resin transfer molding, injection compression molding, thermoforming, etc. Generally, compression molding involves introducing the SMC onto a lower die, then moving one or both dies towards the other to press the SMC under application of heat and pressure in order to conform the SMC to the contour of the die surfaces defining the closed mold cavity. Sheet molding compounds are often pressed within a temperature range of, for example, about 135° C. (275° F.) to about 177° C. (350° F.). The dies exert a pressure on the composition of, for example, about 1000 to about 2000 psi. The pressing operation often lasts, for example, about 30 seconds to 2 minutes. A method for making a SMC door skin is disclosed in U.S. Pat. Pub. No. 2013/0199694. The procedures and parameters herein provided are by way of example, and are not limiting.

The exterior surfaces 18*a* and 20*a* of the door skins 18 and 20 are illustrated as flush with planar surfaces. Alternatively, one or both of the exterior surfaces 18*a* and 20*a* may include contours, such as a contoured portion surrounding and defining an inner molded panel 19, as shown in FIGS. 1 and 2. The inner molded panel(s) 19 may be coplanar with, recessed from, or elevated relative to the planes in which the exterior surfaces 18*a* and 20*a* principally extend. The exterior surfaces 18*a* and 20*a* may be smooth or molded/embossed to simulate a design or pattern, such as a wood grain design. The interior surfaces 18*b* and 20*b* of the door skins 18 and 20 may have relatively rough or textured surfaces to increase the surface area for adhesion to the doorframe 12 and a door core, if one is used. The contour and smoothness/roughness of the exterior surfaces 18*a* and 20*a* and interior surfaces 18*b* and 20*b* can be controlled by selecting mold dies having corresponding cavity-defining surfaces. The door skins 18 and 20 may be mirror images of one another or may possess different contours, patterns, and other features.

The door assembly 10 also includes hardware, such as a door knob 24 and latch 26 on one side of the door assembly 10 and hinges (not shown) on the opposite side of the door assembly 10 for pivotally mounting the door assembly 10 to a wall structure or doorjamb and allowing swinging of the door assembly 10 between open and closed positions. It should be understood that the door assembly 10 may include other hardware, and may be slidable (for example, along tracks) rather than pivotal between open and closed positions.

As best shown in FIGS. 3 and 4, the first and second door skins 18 and 20 include first and second lips 43 and 45, respectively. The first and second lips 43 and 45 are angled relative to the substantially planar major areas of the door skin outer surfaces 18*a* and 20*a*. The first lip 43 terminates at a first elongate rib (or fin) 44 and the second lip 45 terminates at a second elongate rib (or fin) 46. The first and second lips 43 and 45 and their respective ribs 44 and 46 surround and define openings 18*c* and 20*c* (FIG. 3), respectively. The openings 18*c* and 20*c* of the first and second door skins 18 and 20 are aligned with each other.

As best shown in FIGS. 3 and 4, the interior surface 18*b* includes an elongate internal ridge or wall 40 in relatively close proximity to the opening 18*c*. Likewise, the interior surface 20*b* includes an elongated ridge or wall 42 in relatively close proximity to the opening 20*c*. The ridges 40 and 42 preferably are formed integrally with the remainder of the door skins 18 and 20, respectively, for example, during molding. The ridges 40 and 42 extend inwardly towards one another to surround the openings 18*c* and 20*c*, yet are spaced apart from one another by a gap (unnumbered). The ridges 40 and 42 may be used as screw bosses to connect the door skins 18 and 20 to one another. In certain embodiments, as described below and shown in FIG. 12, the ridges 40 and 42 may extend toward one another until they are in contact. In that case, no gap exists between the ridges 40 and 42.

An insulated glazing unit (IGU) 30 is received between the respective openings 18*c* and 20*c* of the first and second door skins 18 and 20. The IGU 30 is illustrated as including first and second panes 34 and 36 secured together by an IGU spacer 32 that separates the panes 34 and 36 from another. It should be understood that the IGU 30 may include one or more additional panes. For example, an additional pane may be secured in face-to-face abutting arrangement with the pane 34 or the pane 36, or the additional pane may be interposed between and spaced apart from both the panes 34 and 36. The panes 34 and 36 may be glass whereas the additional pane may be a polymer material bonded to one of the panes 34 or 36. The IGU may be one that is hurricane rated, such that a polymer film is applied to one or both of the interior surfaces of the panes 34, 36 to minimize breakage due to impact.

An IGU cavity 38 substantially sealed within the IGU frame 32 between the panes 34 and 36 is shown in, for example, FIG. 3. The IGU cavity 38 between the panes 34 and 36 may be filled with a gas, such as, for example, air. In the illustrated first exemplary embodiment of FIGS. 1-5, the IGU 30 is a double-pane insulated IGU. The panes 34 and 36 can be made of, for example, clear sheet glass, tinted glass, and/or textured/patterned glass. The panes 34 and 36 can be made of other transparent materials or combinations of transparent materials, including plastics such as acrylics and polycarbonate. A combination of plastic and glass panes may be used. A decorative grille or insert (not shown) may be included within the IGU cavity 38. Mechanism such as blinds likewise may be included with the IGU cavity 38.

Although not shown, the IGU 30 may include an internal grille or internal grilles within the IGU cavity 38, an external grille on the exterior surface of one of the panes 34 or 36, and/or external grilles on the exterior surfaces of the panes 34 and 36. Similarly, the IGU 30 may include an internal SDL bar or internal SDL bars within the IGU cavity 38, an external SDL bar on the exterior surface of one of the panes 34 or 36, and/or external SDL bars on the exterior surfaces of the panes 34 and 36.

The IGU 30 may have an alternative geometry, such as that of a square, a circle, an oval, a triangle, other polygons, etc. The IGU 30 may possess a combination of linear and curved edges, etc. IGUs are commercially available and often sold as pre-assembled products that can be incorporated into the doors embodied and described herein. The IGU 30 selected may be configured to withstand impact, e.g., to be hurricane rated. Although only a single IGU 30 is shown in each of the illustrated exemplary embodiments, it should be understood that the present invention encompasses a door assembly having two, three, four, or more IGUs. For door assemblies having multiple IGUs, the IGUs may be made of the same or different material from one another, and may have the same or different shapes from one another.

The ribs 44 and 46 of the door skins 18 and 20 contact the exterior surfaces of the panes 34 and 36, respectively, of the glazed unit 30. As best shown in FIG. 3, a sealant and/or adhesive 50 is provided at an interface of an interior surface of the lip 43 and the exterior surface of the pane 34. Similarly, a sealant and/or adhesive 52 is provided at an interface of an interior surface of the lip 45 and the exterior surface of the pane 36. The sealant may be a structural adhesive. The direct securing of the lips 43 and 45 to opposite exterior surfaces of the panes 34 and 36 using sealant/adhesive provides a "frameless" structure, i.e., a frame is not used to interconnect the door skins 18 and 20 to the IGU 30. The ribs 44 and 46 provide a seal to prevent the flow of the sealants and/or adhesives 50 and 52 beyond the interior surfaces 18*b* and 20*b* into the visible area of the panes 34 and 36. Unless otherwise indicated, the sealants and/or adhesives 50 and 52 may be a sealant only, an adhesive only, or a combination of a sealant and an adhesive. In the case of a combination of sealant and adhesive, separate sealants and adhesives can be combined, e.g., intermixed. Alternatively, certain compounds, such as structural sealants, can perform both sealant and adhesive functions. A structural sealant with a commercial impact rating is suitable. The sealant may be a moldable compound, such as a paste or foam, or a component such as a gasket or weather strip. The sealant and/or adhesive 50 may be the same or different from the sealant and/or adhesive 52.

A door core 28 is situated in a door cavity (unnumbered) defined at opposite sides by the interior surfaces 18*b* and 20*b* of the first and second door skins 18 and 20 and at inner and outer peripheries by the IGU spacer 32 and the doorframe 12. Although not shown, there may be a sealant and/or adhesive on the outer surface of the IGU spacer 32. For the purposes of this description, the sealant and/or adhesive is considered part of the IGU spacer 32. The door core 28 can be a foam material, such as a polyurethane foam, and more preferably is formed in situ in the door cavity by introducing a one-component or multiple-component foam precursor into the door cavity of an already assembled door, and allowing foaming to occur in the door cavity so that the core 28 fills the door cavity. Alternatively, one or more preformed door core components may be placed into against the interior surface 18*b* or 20*b* of the door skins 18 or 20 prior to securing the other door skin 18 or 20 thereto. Adhesive may secure the door component(s) to the interior surfaces 18*b* and 20*b*.

Figure 5:
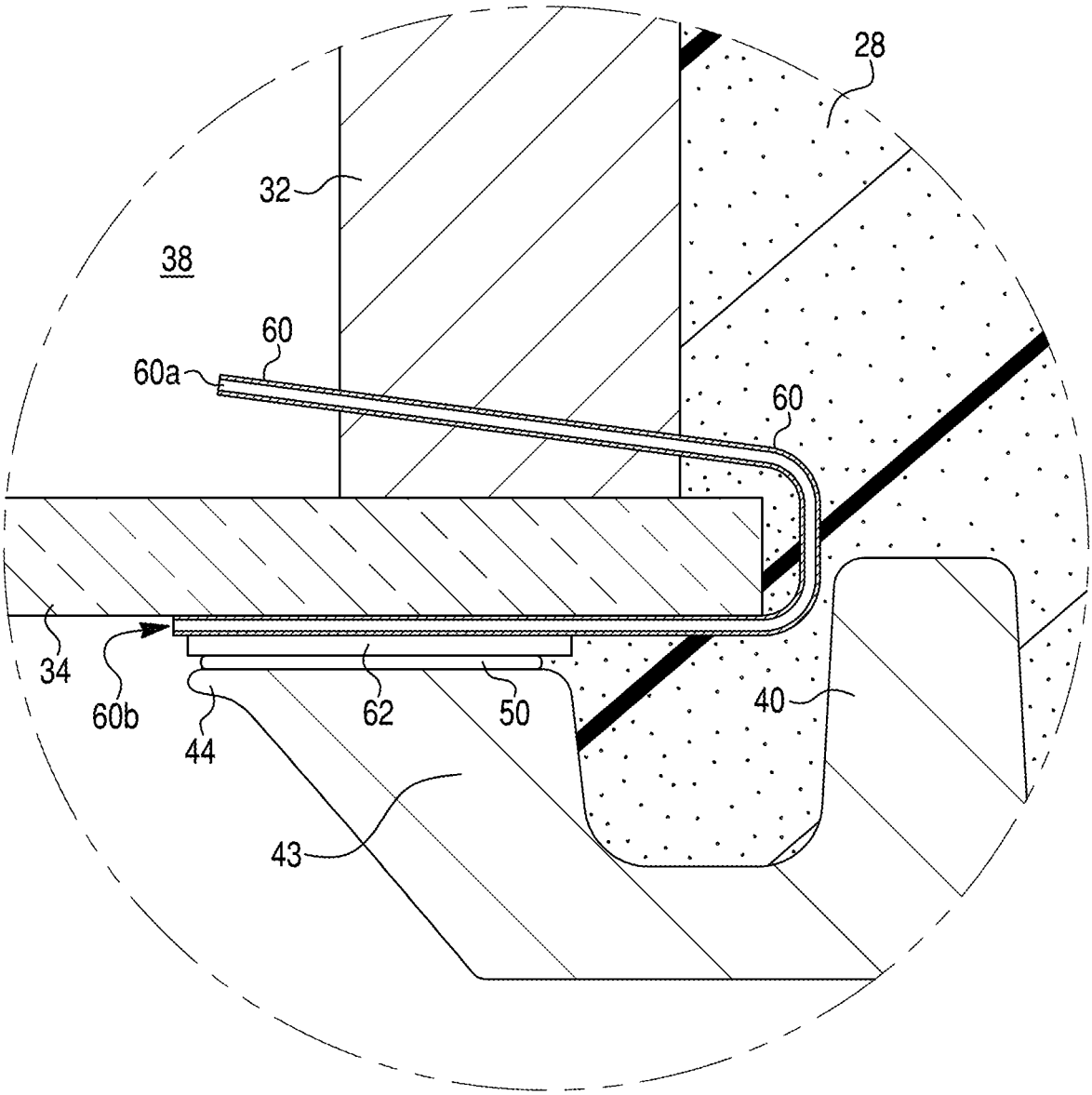
FIG. 5 is an enlarged sectional view of circle 5 of FIG. 4.

As best shown in FIGS. 4 and 5, the door assembly 10 of the first exemplary embodiment of the invention further includes a gas passage conduit 60 embodied as a capillary tube 60. A first end 60*a* of the capillary tube 60 communicates with the IGU cavity 38. The first end 60*a* of the capillary tube 60 extends to and optionally through a first hole (unnumbered) formed (e.g., by drilling) in the IGU spacer 32. The IGU spacer 32 can be a hollow or solid spacer. Thus, the first end 60*a* of the capillary tube 60 is illustrated entering through the outer wall of the hollow IGU spacer 32 and into the IGU cavity 38. However, the first end 60*a* does not necessarily go into the sealed cavity 38 or through the IGU spacer inner wall, which may have slits, holes, or the like for communicating the first end 60*a* with the sealed cavity 38. Those skilled in the art will recognize that a capillary tube, such as the capillary tube 60, has a relatively small diameter opening extending through the tube 60. Although not show, a sealant may be applied at the interface of the IGU spacer 32 and the capillary tube 60 to prevent leaks from the IGU cavity 38.

The opposite second end 60*b* of the capillary tube 60 communicates with atmosphere outside of the door assembly 10. As best shown in FIG. 5, the capillary tube 60 extends through a portion of the door core 28 between the outer surface of the pane 34 and the lip 43 of the first door skin 18. The second end 60*b* of the capillary tube 60 is shown extending slightly beyond the rib 44. Extending the second end 60*b* beyond the rib 44 prevents the sealant 50 from squeezing out past the rib 44 and blocking the second end 60*b* of the capillary tube 60. Alternatively, the rib 44 may extend beyond the second end 60*b*, so that the capillary tube 60 and its second end 60*b* are concealed from sight behind the rib 44 yet in communication with the outside atmosphere.

The second end 60*b* of the capillary tube 60 is in a Day Light Opening (DLO) position to permit the exchange of gas (e.g., air) between the IGU cavity 38 and the outside atmosphere. The gas exchange permits pressure balance and alleviates pressure differentials between the outside atmosphere and the IGU cavity 38 due to, for example, changes in temperature and/or altitude (the latter occurring, for example, during transportation of the door assembly 10). In this regard, because of the relatively small diameter of the opening of the capillary tube 60, the capillary tube 60 allows for a limited exchange of gas with the outside atmosphere Thus, the IGU cavity 38 is referred to herein as substantially sealed. Other than gas exchanged through the capillary tube 60, the IGU cavity 38 preferably is otherwise sealed to prevent gas (e.g., air) from escaping from or entering into the IGU cavity 38.

The capillary tube 60 (of the first and other exemplary embodiments described herein) may be made of stainless steel. Other materials, particularly other non-corrosive metals or plastics may be selected as the capillary tube 60. An exemplary capillary tube has an inner (hole) diameter of about 0.019 inch (about 0.048 cm) and an outer (tube) diameter of about 0.032 inch (about 0.081 cm). These exemplary measurements may differ, for example ±0.005 inch (±0.013 cm), and often slightly differ from manufacturer to manufacturer. Relatively small internal diameters of capillary tubes limit the rate of gas flow between the IGU cavity 38 and the outside atmosphere. If the gas flow is too high, excessive moisture can enter into the IGU cavity 38, leading to loss of thermal performance as well as condensation on the interior surfaces of the panes 34 and 36. On the other hand, if gas flow is too low, pressure balance can take significant time, and can lead to deflection of the panes 34 and 36 and/or seal breakage before pressure is balanced.

As best shown in FIG. 5, the capillary tube 60 extends along an edge of a shim 62, preferably abutting the edge of the shim 62. The cross-sectional view of FIG. 5 depicts the shim 62 behind the capillary tube 60. In the normal vertical orientation of the door assembly 10 illustrated in FIGS. 1 and 2, the shim 62 is positioned below the capillary tube 60. Thus, the capillary tube 60 extends along and preferably abuts the top edge of the shim 62 in the illustrated embodiment. The capillary tube 60 has a thickness (that is, diameter in the illustrated embodiment, measured in a direction perpendicular to the exterior surface of the pane 34) that is equal to or preferably less than the thickness (measured in the same direction) of the shim 62. The shim 62 prevents pinching and/or crushing of the capillary tube 60 between the lip 43/rib 44 and the pane 34.

Figure 6:
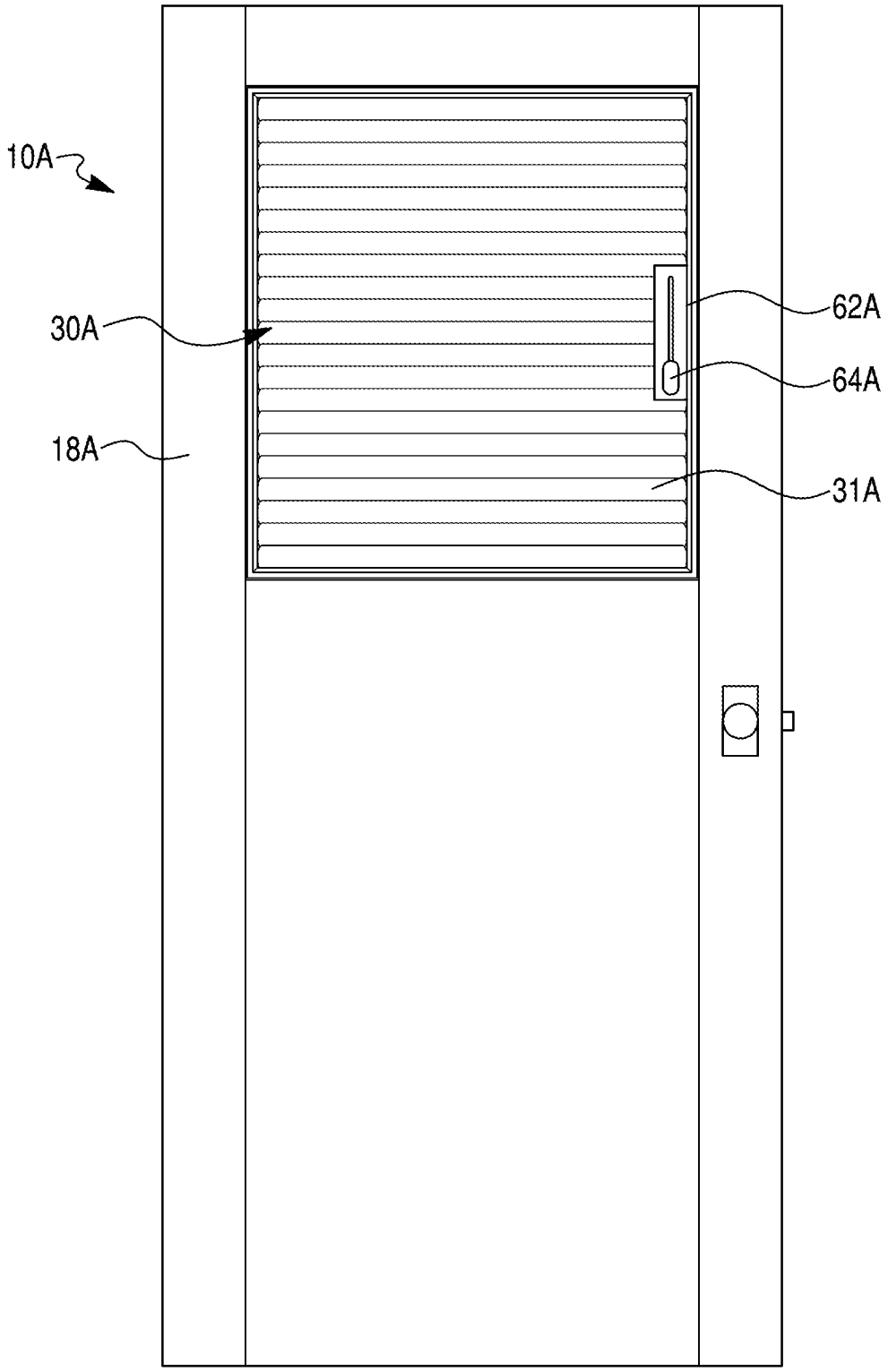
FIG. 6 is a front elevation of a door assembly with insulated glazing unit venting according to a modification of the first exemplary embodiment of the invention.

It should be understood that various modifications can be made to the first exemplary embodiment. For example, the door assembly 10 can include two or more of the capillary tubes 60, for example, spaced about different sides of the insulated IGU 30. The shim 62 can be positioned above or below the capillary tube 60. Another modification is shown in FIG. 6, in which components functionally or structurally similar to the components of the first exemplary embodiment of FIGS. 1-5 are labeled with the same reference numerals with the addition of the suffix capital letter "A". In FIG. 6, IGU 30A includes blinds 31A in the IGU cavity (unnumbered). A sliding adjuster 64A accessible on the exterior surface of the first door skin 18A that controls up/down movement or tilting of blinds 31A of the IGU 30A. The shim 62 of the first exemplary embodiment of FIGS. 1-5 is replaced with a planar flange portion 62A or another structure of a base of the sliding adjuster 64A. The flange portion 62A extends between the pane 34 and the lip 43 of the first door skin 18A. The capillary tube 60 (not shown in FIG. 6, but identical in location to that shown in FIG. 5) extends along an edge the flange portion 62A, which preferably is at least as thick and more preferably thicker than the diameter of the capillary tube 60.

Various methods can be practiced to make the door assembly 10 of the first exemplary embodiment. According to one exemplary method, the first end 60*a* of the gas passage conduit 60 is positioned in communication with the first hole of the IGU 30, and the second end 60*b* of the gas passage conduit 60 and the shim 62 are placed on the first lip 43. The interior surface 18*b* of the first door skin 18 and both surfaces of the shim 62 are coated with an adhesive at least at frame-receiving and IGU-receiving locations. The doorframe 12 and the IGU 30 are then laid on the adhesive-coated first door skin 18. The interior surface 20*b* of the second door skin 20 is coated with an adhesive at least at frame-receiving and IGU-receiving locations. Additionally or alternatively, areas of the IGU 30 and the doorframe 12 that are to receive the second door skin 20 are coated with adhesive. The second door skin 20 is laid on the IGU 30 and the doorframe 12. The assembly may be pressed to permit curing and hardening of the adhesive. The core 28 is formed in situ by spraying or injecting a precursor into the door cavity, preferably after assembly of the door skins 18 and 20, the doorframe 12, the IGU 30, and the gas passage conduit 60. The method may be accomplished using additional or fewer steps. Also, the steps may be performed in different sequences than described herein. For example, the doorframe 12 and the IGU 30 may be laid on the second door skin 20 instead of the first door skin 18.

Figure 7:
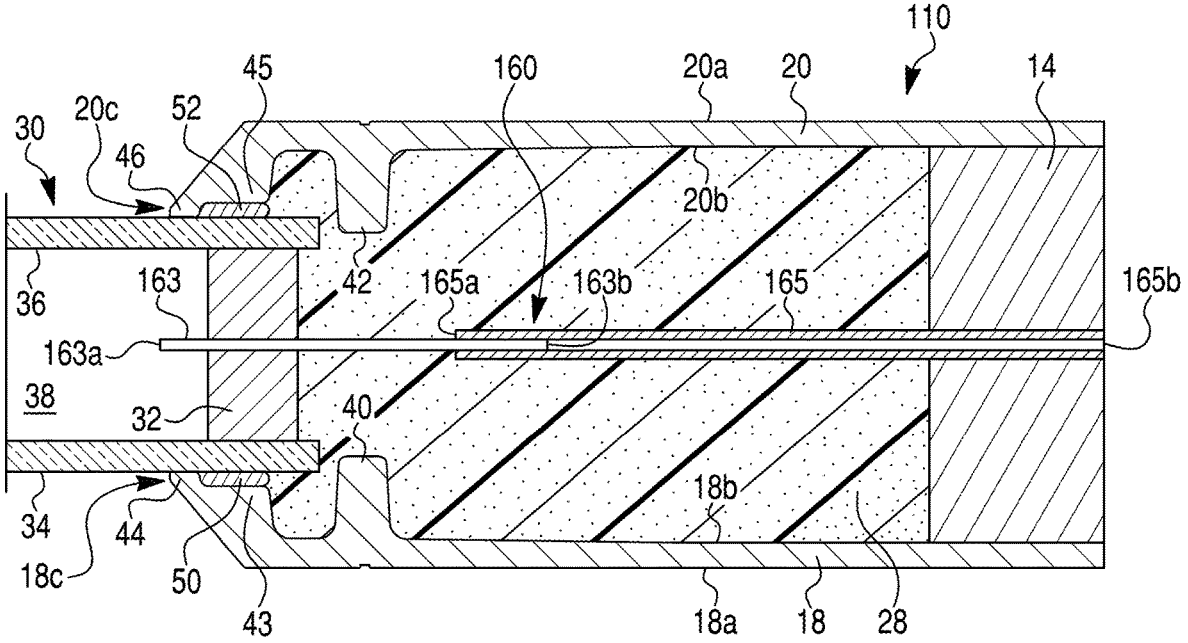
FIG. 7 is a cross-section taken along sectional line 7-7 of FIG. 2 illustrating a door assembly with insulated glazing unit venting according to a second exemplary embodiment of the invention.

FIG. 7 illustrates a cross-sectional view of a door assembly 110 of a second exemplary embodiment of the invention. The door assembly 110 may have the same perspective view and elevational view as depicted in FIGS. 1 and 2, respectively. In FIG. 7, components that are unchanged from the first exemplary embodiment of the present invention are designated with the same reference characters as used above. Corresponding components that are structurally and/or functionally changed from the first exemplary embodiment are designated by the same reference numerals but in the 100 series. For example, gas passage conduit 160 of FIG. 7 generally corresponds to the gas passage conduit 60 of FIGS. 4 and 5.

In the door assembly 110 of the second exemplary embodiment of FIG. 7, the gas passage conduit 160 includes a capillary tube 163 and a thicker vent tube 165. A first end 163*a* of the capillary tube 163 communicates with the IGU cavity 38. The first end 163*a* of the capillary tube 163 extends to and optionally through a first hole (unnumbered) formed (e.g., by drilling) in the IGU spacer 32. The IGU spacer 32 can be a hollow spacer. Thus, the first end 163*a* of the capillary tube 163 is shown entering through the outer wall of the hollow IGU spacer 32 and into the sealed cavity 38. However, the first end 163*a* does not necessarily go into the sealed cavity 38 or through the IGU spacer inner wall, which may have slits, holes, or the like. Although not show, a sealant may be applied at the interface of the IGU spacer 32 and the capillary tube 163 to prevent leaks from the IGU cavity 38.

The opposite second end 163*b* of the capillary tube 163 is received in a first end 165*a* of the thicker vent tube 165 to connect the capillary tube 163 to the vent tube 165. The second end 163*b* may be frictionally fit into the first end 165*a*. Depending on the material for the vent tube, the internal diameter of the vent tube 165 may be larger than the external diameter of the capillary tube 163. This connection is secured by the door core 28, which preferably is formed in situ after assembling the door skins 18 and 20, the IGU 30, and the frame 12 to one another.

The opposite second end 165*b* of the vent tube 165 extends to and preferably through a second hole (unnumbered) in the stile 14 to communicate with atmosphere outside of the door assembly 110. The second hole may be formed in the stile 14 by drilling, for example. A sealant may be provided at the interface of the vent tube 165 and the second hole of the stile 14 to prevent the foam precursor composition from escaping through the second hole during in situ formation of the core 28.

The gas passage conduit 160 allows for the exchange of gas (e.g., air) between the IGU cavity 38 and the outside atmosphere to balance pressure and alleviate pressure differentials between the outside atmosphere and the IGU cavity 38 due to, for example, changes in temperature and/or altitude (the latter occurring, for example, during transportation of the door assembly 110). Notably, the gas passage conduit 160 of this second exemplary embodiment is arranged so as to not become pinched between interfacing structures of the door assembly 110.

It should be understood that various modifications can be made to the second exemplary embodiment. For example, the door assembly 110 can include two or more of the gas passage conduits 160, for example, spaced about the perimeter of the IGU 30. As another modification, the capillary tube 163 and the vent tube 165 may be joined end-to-end, rather than overlapping as shown. As still another modification, the vent tube 165 can be omitted so that the capillary tube 163 extends continuously from the substantially sealed IGU cavity 38 to and optionally through the second hole in the stile 14. According to a further modification, the gas passage conduit 160 may extend through one of the rails 16, preferably the lower rail, rather than one of the stiles 14, to better conceal the second opening in the doorframe 12 from view.

Various methods can be practiced to make the door assembly 110 of the second exemplary embodiment. According to one exemplary method, the interior surface 18*b* of the first door skin 18 is coated with an adhesive at frame-receiving and IGU-receiving locations. The doorframe 12 and the IGU are laid on the adhesive-coated first door skin 18. The first end 163*a* of the gas passage conduit 160 is positioned in communication with the first hole of the IGU 30, and the second end 165*b* of the gas passage conduit 160 is positioned in communication with the second hole in the doorframe 12. The interior surface 20*b* of the second door skin 20 is coated with an adhesive at frame-receiving and IGU-receiving locations. Additionally or alternatively, areas of the IGU 30 and the doorframe 12 that are to receive the second door skin 20 are coated with adhesive. The second door skin 20 is then laid on the IGU 30 and the doorframe 12. The assembly may be pressed to permit curing and hardening of the adhesive. The core 28 is formed in situ by spraying or injecting a precursor composition into the door cavity. The method may be accomplished using additional or fewer steps. Also, the steps may be performed in different sequences than described herein.

Figure 8:
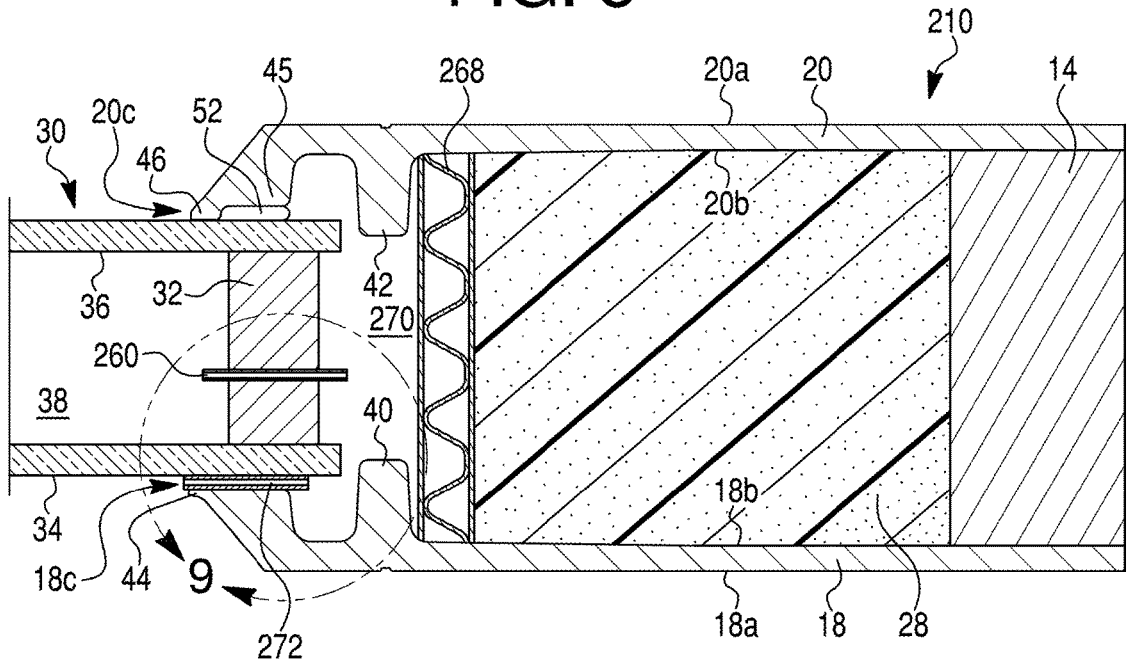
FIG. 8 is a cross-sectional view taken along sectional line 8-8 of FIG. 2 illustrating a door assembly with insulated glazing unit venting according to a first variation of a third exemplary embodiment of the invention.
Figure 9:
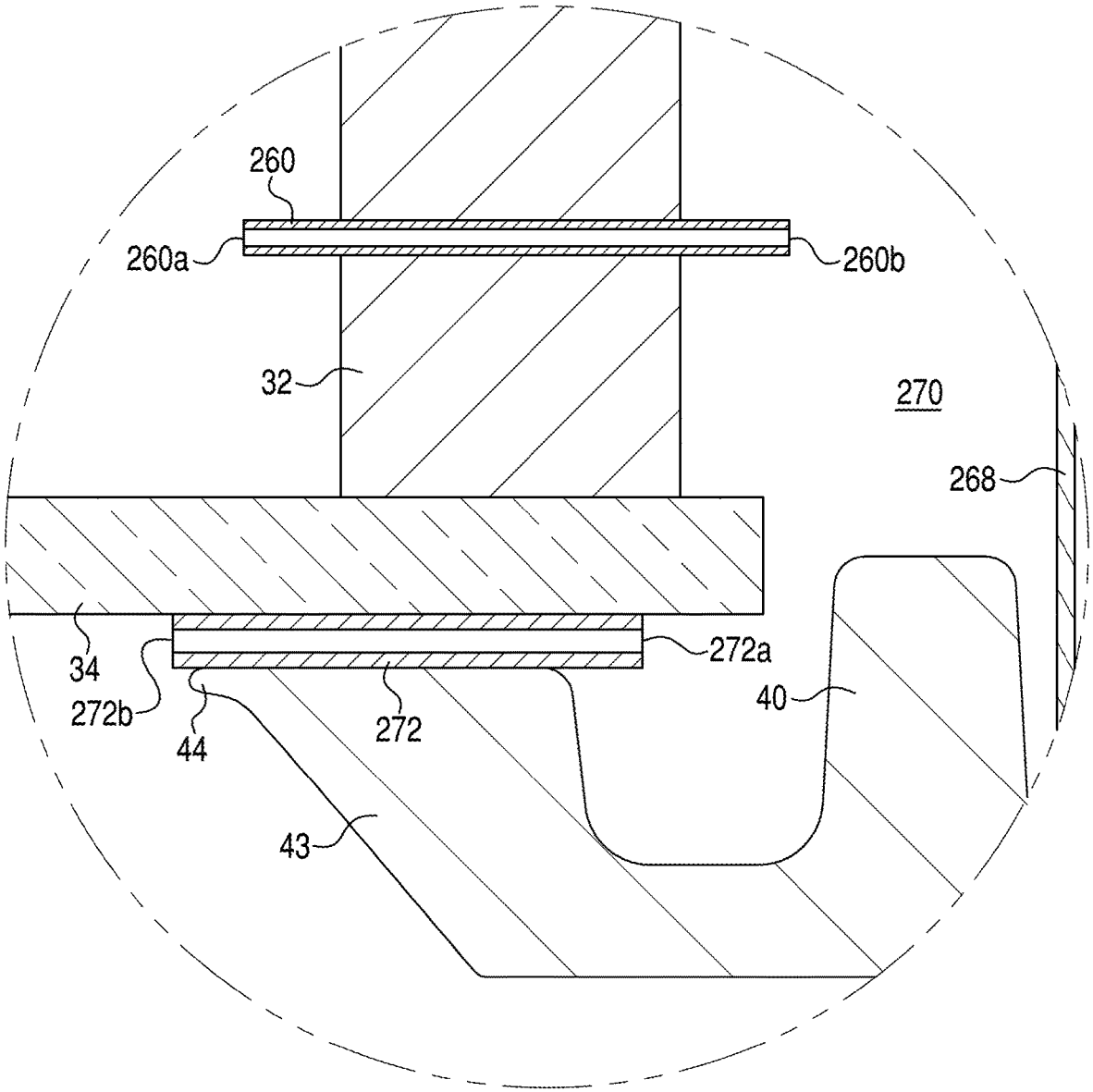
FIG. 9 is an enlarged sectional view of circle 9 of FIG. 8.

FIGS. 8 and 9 illustrate a cross-sectional view of a door assembly 210 of a third exemplary embodiment of the invention. The door assembly 210 may have the same perspective view and elevational view as depicted in FIGS. 1 and 2, respectively. In FIGS. 8 and 9, components that are unchanged from the first exemplary embodiment of the present invention are labeled with the same reference characters as used above. Corresponding components that are structurally and/or functionally changed from the first exemplary embodiment are designated by the same reference numerals but in the 200 series. For example, gas passage conduit 260 of FIGS. 8 and 9 generally corresponds to the gas passage conduit 60 of FIGS. 4 and 5.

In FIGS. 8 and 9, the door assembly 210 further includes a dam 268 that extends across the interior thickness of the door cavity from the interior surface 18*b* of the first door skin 18 to the interior surface 20*b* of the second door skin 20. The dam 268 may also abut against the internal ridges 40 and 42 of the first and second door skins 18 and 20. The dam 268 thereby partitions the door cavity that receives the door core 28 from an air pocket 270. The air pocket 270 is defined at its opposite sides by the interior surfaces 18*b* and 20*b* of the first and second skins 18 and 20, respectively, and at its inner and outer peripheries by the IGU spacer 32 and the dam 268. The air pocket 270 and the dam 268 space the door core 28 from the IGU 30. The dam 268 is made of a material that prevents leakage of the core precursor therethrough, so that the door core foam precursor introduced into the door cavity does not leak into the air pocket 270. The dam 268 may be made of a variety of materials, but preferably is made of a relatively low weight material, such as corrugated cardboard. Alternatively, as illustrated in FIG. 12, the ridges 40 and 42 extend toward one another until they are in contact, essentially forming a dam partitioning the door cavity that receives the door core 28 from the air pocket 270.

Figure 12:
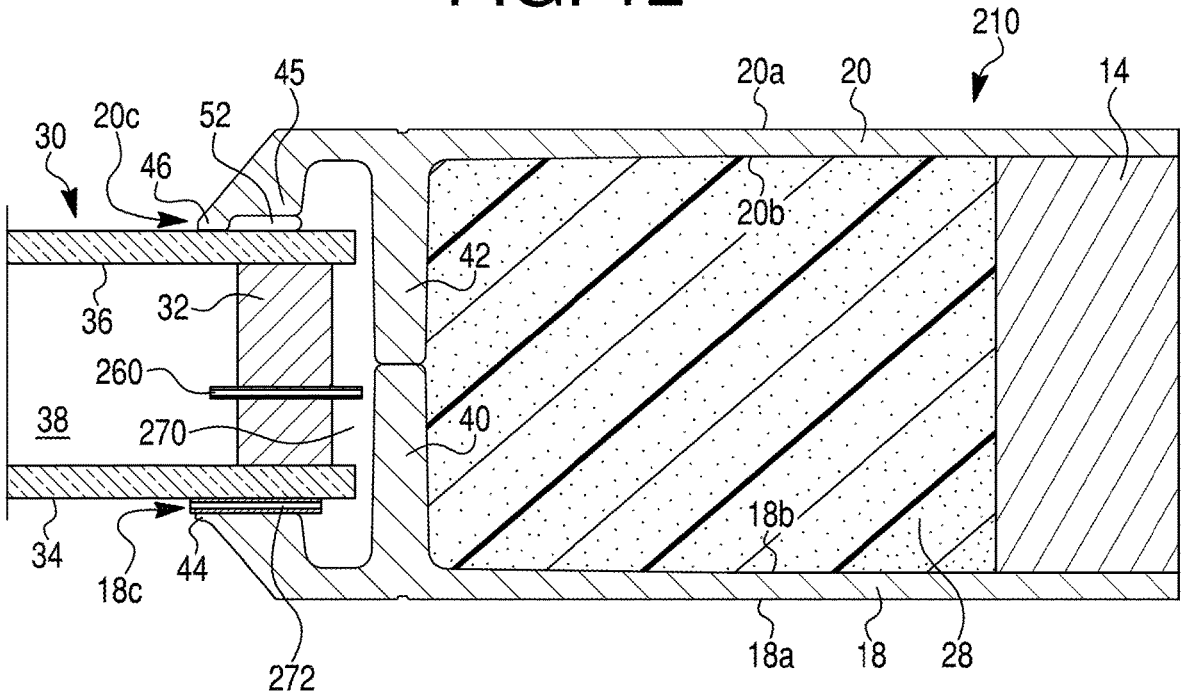
FIG. 12 is a cross-sectional view taken along sectional line 12-12 of FIG. 2 illustrating a door assembly with insulated glazing unit venting according to a second variation of the third exemplary embodiment of the invention.

A gas passage conduit 260 embodied as a capillary tube in FIGS. 8, 9, and 12 has a first end 260*a* that communicates with the IGU cavity 38. The first end 260*a* of the capillary tube 260 extends to and optionally through a first hole (unnumbered) formed (e.g., by drilling) in the IGU spacer 32. The IGU spacer 32 can be a hollow spacer. Thus, the first end 260*a* of the capillary tube 260 may enter through the outer wall of the hollow IGU spacer 32, but does not necessarily go into the sealed cavity 38 or through the IGU spacer inner wall, which may have slits, holes, or the like for communicating the first end 260*a* with the sealed cavity 38. Although not show, a sealant may be applied at the interface of the IGU spacer 32 and the capillary tube 260 to prevent leaks from the IGU cavity 38.

The opposite second end 260*b* of the capillary tube 260 communicates with the air pocket 270. A channel (unnumbered) in the form of a gap extends between the outer surface of the pane 34 and the interior surface of the lip 43 of the first door skin 18 in the cross-section of FIG. 8. In the illustrated embodiment, a vent tube 272 is positioned within the channel, and provides fluid communication between the air pocket 270 and the outside atmosphere. A first end 272*a* of the vent tube 272 is located in the air pocket 270, and a second end 272*b* of the vent tube 272 is shown extending slightly beyond the rib 44. Extending the second end 272*b* of the vent tube 272 beyond the rib 44 prevents the sealant 50 from squeezing out past the rib 44 and blocking the second end 272*b* of the vent tube 272. Alternatively, the rib 44 may extend beyond the second end 272*b* of the vent tube 272, so that the vent tube 272 is concealed from sight behind the rib 44 yet in communication with the outside atmosphere.

The second end 272*b* of the vent tube 272 is in a Day Light Opening (DLO) position. The capillary tube 260, the air pocket 270, and the vent tube 272 collectively allow for the flow and exchange of gas (e.g., air) between the IGU cavity 38 and the outside atmosphere to balance pressure and alleviate pressure differentials between the outside atmosphere and the IGU cavity 38 due to, for example changes in temperature and/or altitude (the latter occurring, for example, during transportation of the door assembly 210).

It should be understood that various modifications can be made to the third exemplary embodiment. For example, the door assembly 210 may include two or more of the capillary tubes 260 and/or two or more of the vent tubes 272, for example, spaced about the IGU 30. Although not shown, the vent tube 272 can be placed adjacent to a shim similar to the shim 62 to prevent accidental pinching of the vent tube 272. The vent tube 272 is optional, and may be omitted to provide an empty gap (between the lip 43 and the pane 34) as the channel that places the air pocket 270 in fluid communication with the outside atmosphere. The empty gap can be made by including a temporary component between the lip 43 and the exterior surface of the pane 34 when assembling the door assembly 210, and removing the temporary component subsequent to assembling the door assembly 210.

Figure 13:
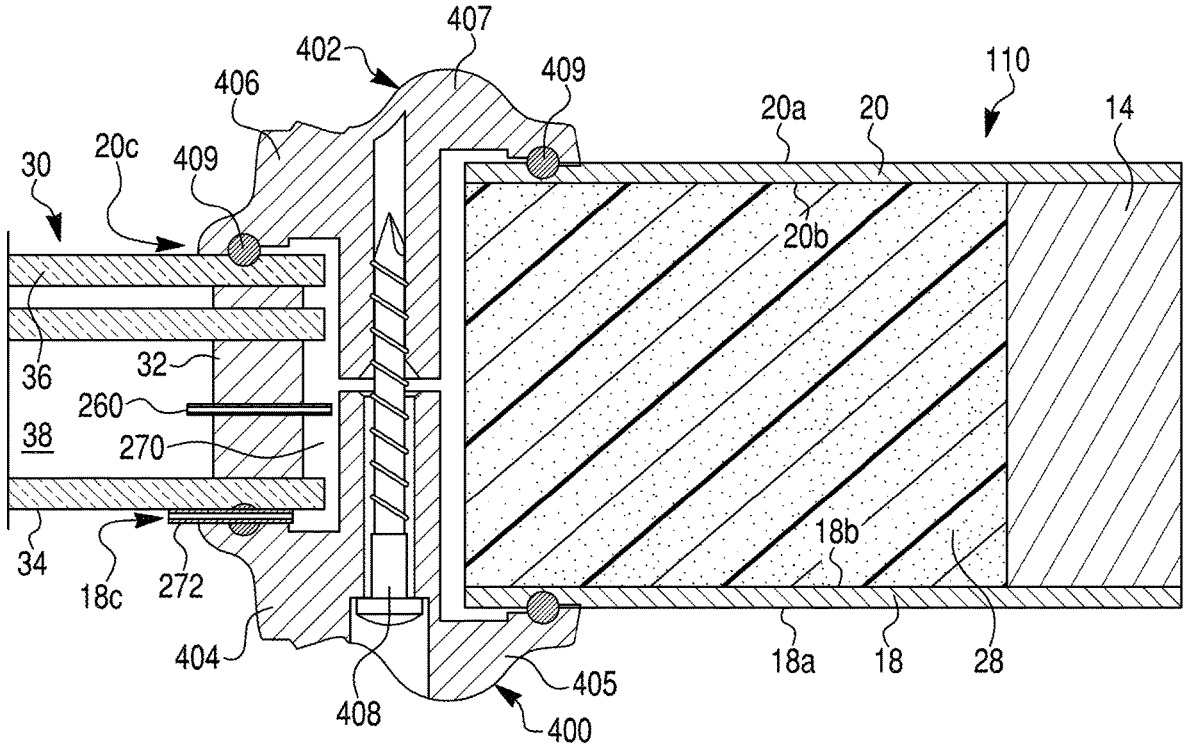
FIG. 13 is a fragmentary cross-sectional view of a door assembly where the insulated glazing unit is fixed in place with insulated glazing unit frames.

For example, the capillary tube 260 and vent tube 272 configuration shown in FIG. 12 may also be practiced with the door assembly 210 shown in FIG. 13. In FIG. 13, the door assembly 210 includes a first IGU frame 400 and a second IGU frame 402, which hold the IGU 30 in the openings 18*c* and 20*c*. The first and second IGU frames 400 and 402 are connected together with a fastener 408, e.g. a screw as illustrated in FIG. 13, to fix the IGU 30 in place. The first IGU frame 400 contains a first portion 404 that presses, and preferably seals against the first pane 34 with a sealant 409, and a second portion 405 that presses, and preferably seals against the first door facing 18 with the sealant 409. Likewise, the second IGU frame 402 contains a first portion 406 that presses, and preferably seals to the second pane 36 with the sealant 409, and a second portion 407 that presses, and preferably seals to the second door facing 20 with the sealant 409. The first and second IGU frames 400 and 402 hold the IGU 30 in spaced relation to the door core 28. The space between the door core 28 and the IGU 30 forms an air pocket 270 that is enclosed by the IGU 30, the first and second IGU frames 400 and 402, and the door core 28 (along with the door skins 18 and 20). As previously described for FIGS. 8, 9, and 12, a gas passage conduit 260, embodied as a capillary tube, allows for gas communication between the IGU cavity 38 and the air pocket 270; and a vent tube 272 provides fluid communication between the air pocket 270 and the outside atmosphere. As illustrated in FIG. 13, the locations of the gas passage conduit 260 is identical to that described above for FIG. 9. The vent tube 272 is positioned within a channel (unnumbered) in the form of a gap extending between the outer surface of the pane 34 and the interior surface of the first portion 404 of the first IGU frame 400. In the illustrated embodiment, a vent tube 272 is positioned within the channel.

Various methods can be practiced to make the door assembly 210 of the third exemplary embodiment. According to one exemplary method, the interior surface 20*b* of the second door skin 20 is coated with an adhesive at frame-receiving and IGU-receiving locations. The doorframe 12 and the IGU 30 are then laid on the adhesive-coated second door skin 20. The first end 260*a* of the gas passage conduit 260 is positioned in communication with the first hole of the IGU 30, and the second end 260*b* of the gas passage conduit 260 is placed on the air pocket 270. The dam 268 is set on the interior surface 20*b* of the second door skin 20 adjacent to and abutting the ridge 42. The interior surface 18*b* of the first door skin 18 is coated with an adhesive at frame-receiving and IGU-receiving locations. Additionally or alternatively, areas of the IGU 30 and the doorframe 12 that are to receive the first door skin 18 are coated with adhesive. The first door skin 18 is then laid on the IGU 30 and the doorframe 12. The vent tube 272 is inserted into the channel between the pane 34 and the lip 43. The assembly may be pressed to permit curing and hardening of the adhesive. The core 28 is formed in situ by spraying or injecting a precursor composition into the door cavity. The method of this third exemplary embodiment may be accomplished using additional or fewer steps. Also, the steps may be performed in different sequences than described herein.

Figure 10:
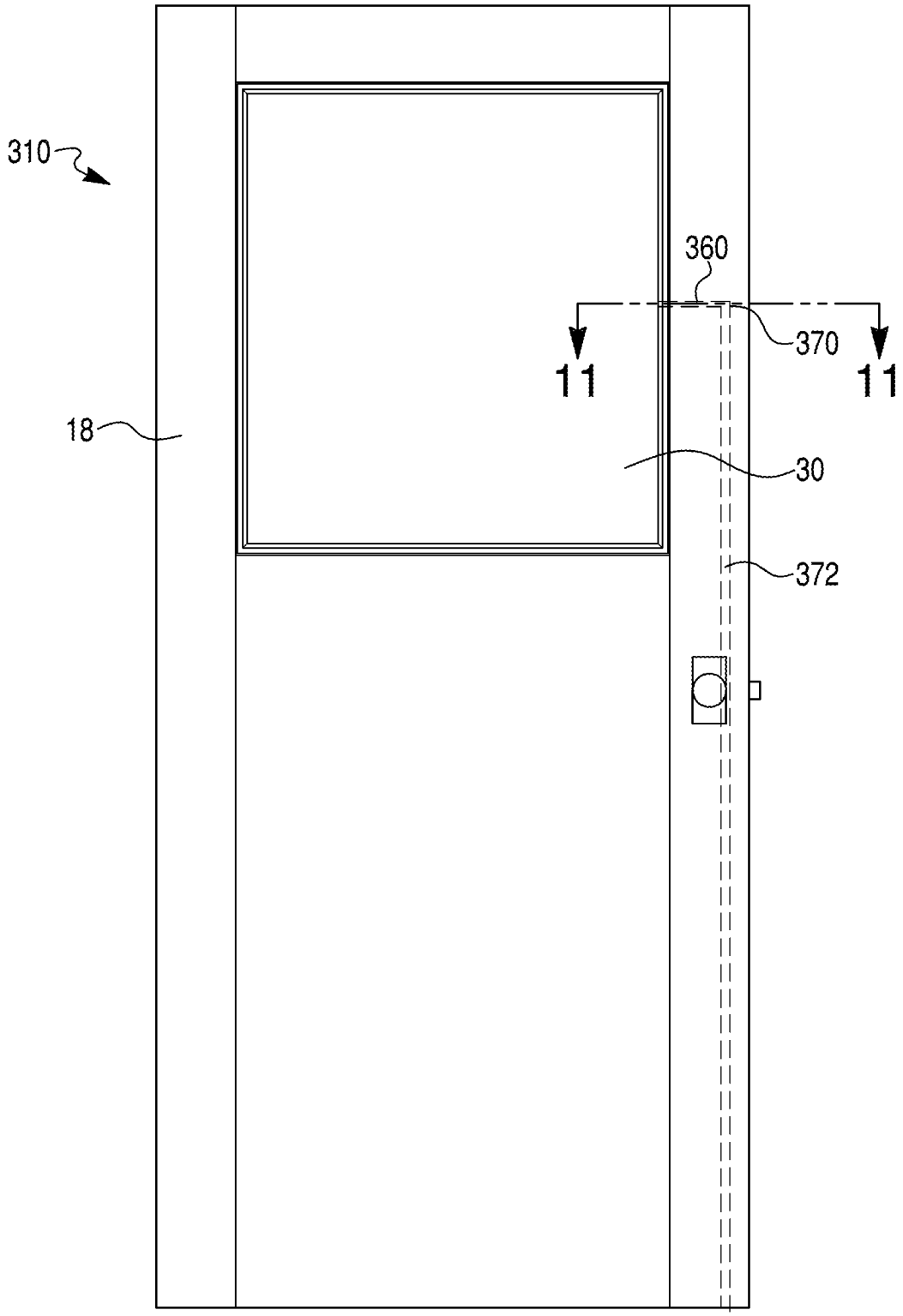
FIG. 10 is a front elevation of a door assembly with insulated glazing unit venting according to a fourth exemplary embodiment of the invention.
Figure 11:
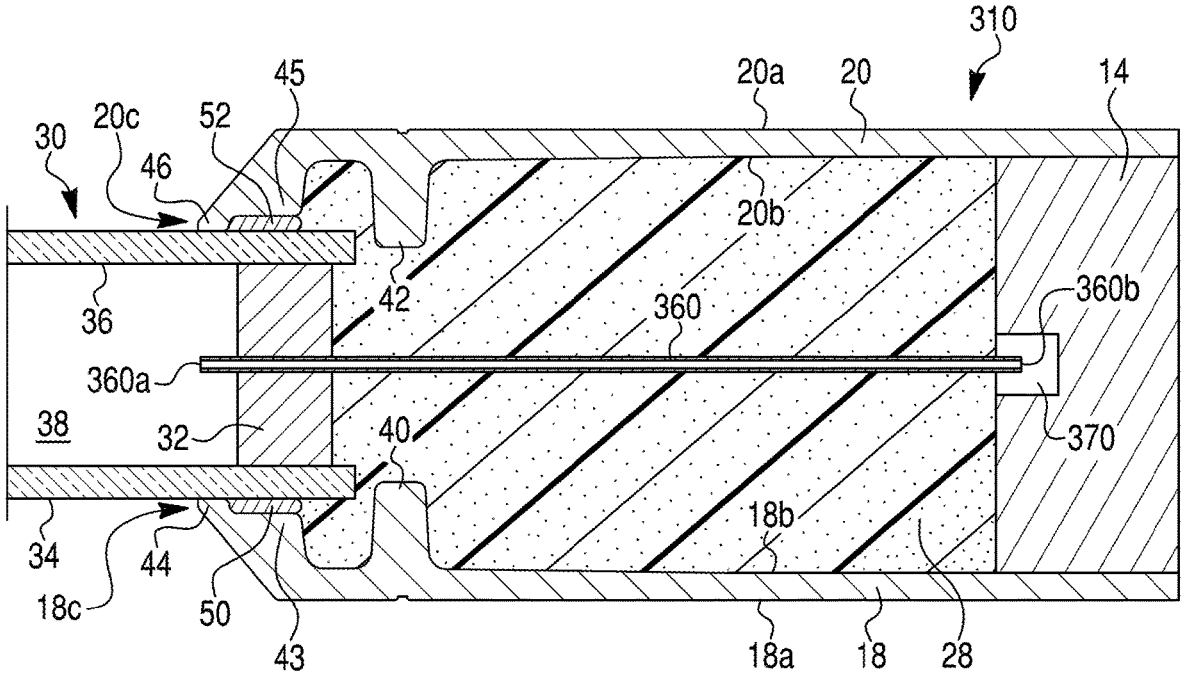
FIG. 11 is a cross-sectional view taken along sectional line 11-11 of FIG. 10 illustrating a door assembly with insulated glazing unit venting according to a fourth exemplary embodiment of the invention.

FIGS. 10 and 11 illustrate a fourth exemplary embodiment of a door assembly. In FIGS. 10 and 11, components that are unchanged from the first exemplary embodiment of the present invention are labeled with the same reference characters as used above. Corresponding components that are structurally and/or functionally changed from the first exemplary embodiment are designated by the same reference numerals but in the 300 series. For example, gas passage conduit 360 of FIGS. 10 and 11 generally corresponds to the gas passage conduit 60 of FIGS. 4 and 5.

In the fourth exemplary embodiment of FIGS. 10 and 11, the gas passage conduit 360 is embodied as a capillary tube having a first end 360*a* in communication with the IGU cavity 38. The first end 360*a* of the capillary tube 360 extends to and optionally through a first hole (unnumbered) formed (e.g., by drilling) in the IGU spacer 32. The IGU spacer 32 can be a hollow spacer. Thus, the first end 360*a* of the capillary tube 360 may enter through the outer wall of the hollow IGU spacer 32 and into the IGU cavity 38. However, the first end 360*a* does not necessarily go into the sealed cavity 38 or through the IGU spacer inner wall, which may have slits, holes, or the like for communicating the first end 360*a* with the sealed cavity 38. Although not show, a sealant may be applied at the interface of the IGU spacer 32 and the capillary tube 360 to prevent leaks from the IGU cavity 38.

The opposite second end 360*b* of the capillary tube 360 extends through the door core 28 and to an air pocket 370 formed in the stile 14. The air pocket 370 is in turn in communication with a channel 372 that communicates with atmosphere outside of the door assembly. The air pocket 370 and the channel 372 may be embodied as a kerf in the stile 14. To simplify construction, the gas passage conduit 360 may be inserted through the door cavity prior to formation or insertion of the door core 28.

The gas passage conduit 360, the air pocket 370, and the channel 372 collectively allow for the exchange of gas (e.g., air) between the IGU cavity 38 and the outside atmosphere to balance pressure and alleviate pressure differentials between the outside atmosphere and the IGU cavity 38 due to, for example changes in temperature and/or altitude (the latter occurring, for example, during transportation of the door assembly 310). Notably, the gas passage conduit 360 of this fourth exemplary embodiment is arranged so as to not become pinched between interfacing structures of the door assembly 310.

It should be understood that various modifications can be made to the fourth exemplary embodiment. For example, the door assembly 310 can include two or more of the gas passage conduits 360, for example, spaced about the perimeter of the IGU 30. As another modification, the gas passage conduit 360 can comprise a combination of a capillary tube and a vent tube, similar as discussed above and illustrated in FIG. 7 in connection with the second exemplary embodiment. According to a further modification, the gas passage conduit 360 may extend to and the channel 372 may be located in one of the rails 16, preferably the lower rail, rather than one of the stiles 14, to better conceal the second end of the channel 372 from view.

Various methods can be practiced to make the door assembly 310 of the fourth exemplary embodiment. According to one exemplary method, the channel or kerf 372 is formed in the doorframe 12. The interior surface 18*b* of the first door skin 18 is coated with an adhesive at least at frame-receiving and IGU-receiving locations. The doorframe 12 and the IGU 30 are then laid on the adhesive-coated first door skin 18. The first end 360*a* of the gas passage conduit 360 is positioned in communication with the first hole of the IGU 30, and the second end 360*b* of the gas passage conduit 360 is inserted into communication with the air pocket 370 of the doorframe 12. The interior surface 20*b* of the second door skin 20 is coated with an adhesive at least at frame-receiving and IGU-receiving locations. Additionally or alternatively, areas of the IGU 30 and the doorframe 12 that are to receive the second door skin 20 are coated with adhesive. The second door skin 20 is then laid on the IGU 30 and the doorframe 12. The assembly may be pressed to permit curing and hardening of the adhesive. The core 28 is formed in situ by spraying or injecting a precursor into the door cavity. The method may be accomplished using additional or fewer steps. Also, the steps may be performed in different sequences than described herein.

The structures, components, steps, and other features of the embodiments described above may be combined with one another, substituted into one another, and modified by persons skilled in the art having reference to this disclosure. Although the above embodiments have been described in connection with "frameless" door assemblies, the various aspects and exemplary embodiments may be practiced with doors having interconnecting frames (that interconnect the IGU to the door skins), for example, such as those described in U.S. Application Publication No. 2008/0245003. In such doors, the gas passage conduits may extend, for example, between an IGU pane and the lip of a frame member of the interconnecting frame and/or through the interconnecting frame to and optionally through the door frame.

An advantage of exemplary embodiments described herein is that the gas passage conduit (alone or in combination with the pocket and channel) allows the IGU to "breathe" and balance pressure between inside and outside of the IGU when a pressure differential arises, e.g., due to change in temperature and/or altitude. Another advantage of exemplary embodiments described herein is that foam precursor introduced into the door cavity does not seal either end of the gas passage conduit. Still another advantage of exemplary embodiments is that door structures, such as between the IGU and a door skin, do not pinch the gas passage conduit. Such advantages may be amplified where the IGU is a full lite, occupying a majority of the door area, with the result that there is a greater length of glazing pane that may be deflected. This invention is not necessarily limited to any one or more of the aforementioned advantages.

Although the above exemplary embodiments have been described in connection with doors, a person of ordinary skill in the art having reference to this disclosure will understand that the principles described herein may be applied to other articles, including building window assemblies, airplane windows, vehicle windows, thermal chambers, etc. Such articles generally include a frame having opposite first and second side, an IGU comprising a substantially sealed IGU cavity and a first hole communicating with the substantially sealed IGU cavity, first and second sheet panels respectively secured to the first and second sides of the frame and having respective first and second openings between which the insulated glazing unit. In one embodiment, the article includes a gas passage conduit comprising a first end communicating with the substantially sealed IGU cavity through the first hole and a second end communicating with atmosphere outside of the article. In another embodiment, the article includes a gas passage conduit comprising a first end communicating with the substantially sealed IGU cavity through the first hole and a second end communicating with an air pocket within the article, and a channel connecting the air pocket with atmosphere outside of the article. The article may be structured, made and used in accordance with any of the aspects and exemplary embodiments described herein.

The foregoing detailed description of the certain exemplary embodiments has been provided for the purpose of explaining the principles of the invention and its practical application, thereby enabling others skilled in the art to understand the invention for various embodiments and with various modifications as are suited to the particular use contemplated. This description is not necessarily intended to be exhaustive or to limit the invention to the precise embodiments disclosed. The specification describes specific examples to accomplish a more general goal that may be accomplished in another way.

What is claimed is:

1. A door assembly, comprising:

a doorframe having opposite first and second sides;

an insulated glazing unit (IGU) comprising a substantially sealed IGU cavity and a first hole communicating with the substantially sealed IGU cavity;

first and second door skins respectively secured to the first and second sides of the doorframe and having respective first and second openings between which the IGU is provided;

a door core component positioned within a door cavity between the first and second door skins, and in direct contact with the IGU; and a gas passageway passing through at least a portion of the door core component, the gas passageway providing gas communication between the sealed IGU cavity and the atmosphere outside the door assembly, wherein the gas passageway comprises a gas passage conduit, an air pocket, and a channel, the gas passage conduit provides gas communication between the IGU cavity and the air pocket and the channel provides gas communication between the air pocket and the atmosphere outside of the door assembly, the air pocket is located in the doorframe, and the channel extends through the doorframe to permit communication for gas exchange between the air pocket and the atmosphere outside of the door assembly.

2. The door assembly of claim 1, wherein the gas passage conduit comprises a capillary tube having a first end communicating with the substantially sealed IGU cavity through the first hole and a second end communicating with the air pocket.

3. The door assembly of claim 1, wherein the insulated glazing unit comprises an IGU spacer, first and second glazing panes, the substantially sealed IGU cavity established by the IGU spacer and the first and second glazing panes, and the first hole communicating with the substantially sealed IGU cavity.

4. The door assembly of claim 3, wherein the first hole is in the IGU spacer and the gas passage conduit extends through the first hole.

5. The door assembly of claim 3, wherein the first door skin has a first lip secured to a first exterior surface of the first glazing pane of the insulated glazing unit and the second door skin has a second lip secured to a second exterior surface of the second glazing pane of the insulated glazing unit, the first exterior surface being opposite to the second exterior surface.

6. The door assembly of claim 1, wherein:

the insulated glazing unit further comprises a blind located within the substantially sealed IGU cavity and a blind operator located on the first exterior surface of the insulated glazing unit.

7. The door assembly of claim 1, wherein the channel is a kerf in the doorframe.

8. The door assembly of claim 1, wherein the gas passage conduit is a capillary tube.

9. A door assembly, comprising:

a doorframe having opposite first and second sides;

an insulated glazing unit (IGU) comprising a substantially sealed IGU cavity and a first hole communicating with the substantially sealed IGU cavity;

first and second door skins respectively secured to the first and second sides of the doorframe and having respective first and second openings between which the IGU is provided, wherein the first and second doors skins are sealed, directly or indirectly, to the IGU;

a door core component positioned within a door cavity between the first and second door skins, and spaced from the IGU to provide an air pocket therebetween; and a gas passageway comprising a gas passage conduit, the air pocket, and a channel, the gas passage conduit provides gas communication between the IGU cavity and the air pocket and the channel provides gas communication between the air pocket and the atmosphere outside of the door assembly.

10. The door assembly of claim 9, further comprising a dam separating the door core from the air pocket.

11. The door assembly of claim 10, wherein the IGU further comprises an IGU spacer, a first glazing pane having a first exterior surface, a second glazing pane having a second exterior surface that is opposite to the first exterior surface, the channel extends between the first exterior surface of the first glazing pane of the IGU and a lip of the first door skin.

12. The door assembly of claim 11, further comprising a first IGU frame and a second IGU frame holding the IGU in the openings, the first IGU frame comprises a first portion sealed to a first side of the IGU and a second portion sealed to the first door skin, the second IGU frame comprises a first portion sealed to a second side of the IGU and a second portion sealed to the second door skin, the channel is positioned between the first side of the IGU and the first portion of the first IGU.

13. The door assembly of claim 12, further comprising a vent tube extending through the channel to permit gas communication between the air pocket and the atmosphere outside of the door assembly.

14. The door assembly of claim 10, further comprising a vent tube extending through the channel to permit gas communication between the air pocket and the atmosphere outside of the door assembly.

15. The door assembly of claim 9, wherein each of the first and second door skins comprises first and second ridges extending toward and abutting one another, the abutting first and second ridges separating the door core from the air pocket.

16. The door assembly of claim 9, wherein the gas passage conduit is a capillary tube.

17. A method of venting an insulated glazing unit positioned within a door, comprising the steps of:

a. providing a door comprising a peripheral frame, first and second door skins secured to opposed sides of the door frame, and an insulated glazing unit (IGU) sealed, directly or indirectly, to the first and second door skins;
b. forming an opening in the periphery of the IGU;
c. forming an air pocket and a channel in the doorframe, the channel extends through the doorframe to permit communication for gas exchange between the air pocket and an atmosphere outside of the door assembly; and
d. providing a gas passage conduit having a first end connected to the opening and a second end connected to the air pocket, and thereby allowing fluid communication between the IGU and the atmosphere surrounding the door.

18. The method of claim 17, wherein the gas passage conduit is a capillary tube.

* * * * *